US005543287A

United States Patent [19]

Arai

[11] Patent Number: 5,543,287

[45] Date of Patent: Aug. 6, 1996

[54] SILVER HALIDE PHOTOGRAPHIC LIGHT-SENSITIVE MATERIAL

[75] Inventor: Takeo Arai, Hino, Japan

[73] Assignee: Konica Corporation, Tokyo, Japan

[21] Appl. No.: 372,827

[22] Filed: Jan. 13, 1995

Related U.S. Application Data

[63] Continuation of Ser. No. 80,054, Jun. 22, 1993, abandoned, which is a continuation of Ser. No. 757,266, Sep. 10, 1991, abandoned.

[30] Foreign Application Priority Data

Sep. 14, 1990 [JP] Japan ..... 2-244558
Sep. 20, 1990 [JP] Japan ..... 2-251420

[51] Int. Cl.[6] ..... G03C 1/047

[52] U.S. Cl. ..... 430/628; 430/535; 430/642; 430/264; 430/627; 430/950; 430/396; 430/939; 430/527; 430/529; 430/530

[58] Field of Search ..... 430/628, 535, 430/642, 264, 627, 950, 396, 939, 527, 529, 530

[56] References Cited

U.S. PATENT DOCUMENTS

| | | | |
|---|---|---|---|
| 2,956,884 | 10/1960 | Caldwell | 430/628 |
| 3,600,208 | 8/1971 | Abbott et al. | 430/535 |
| 4,244,988 | 1/1981 | Dodwell | 430/535 |
| 5,026,632 | 6/1991 | Bagchi et al. | 430/628 |
| 5,061,595 | 10/1991 | Gingello et al. | 430/264 |
| 5,066,572 | 11/1991 | O'Connor et al. | 430/628 |
| 5,122,445 | 6/1992 | Ishigaki | 430/264 |

FOREIGN PATENT DOCUMENTS

| | | |
|---|---|---|
| 793549 | 4/1958 | United Kingdom . |
| 832091 | 4/1960 | United Kingdom . |

OTHER PUBLICATIONS

Webster's New World Dictionary, Third College Edition (1988) p. 588.

Japanese Abstract, vol. 12, No. 411, Oct. 31, 1988.

Bottcher, H. and Epperlein, J., "Moderne Photographische System," 1983, pp. 104–107.

Research Disclosure, No. 195, Jul. 1980, pp. 301–310, Anonymous: "Photographic applications of latices".

*Primary Examiner*—Mark F. Huff

*Attorney, Agent, or Firm*—Finnegan, Henderson, Farabow, Garrett & Dunner, L.L.P.

[57] ABSTRACT

A silver halide photographic material and a method for processing the same are disclosed. The silver halide photographic material has a support and a silver halide emulsion layer. The emulsion layer contains polymer latex bonded with gelatin and not less than 70 wt. % of the polymer latex is present. Dimensional stability is improved by the combination of a high portion of polymer latex with the gelatin.

14 Claims, No Drawings

SILVER HALIDE PHOTOGRAPHIC LIGHT-SENSITIVE MATERIAL

This application is a continuation of application Ser. No. 08/080,054, filed Jun. 22, 1993, now abandoned, which was a continuation of application Ser. No. 07/757,266, filed Sep. 10, 1991, now abandoned.

FIELD OF THE INVENTION

The present invention relates to a silver halide photographic light-sensitive material, more specifically to a silver halide photographic light-sensitive material which is excellent in dimensional stability.

BACKGROUND OF THE INVENTION

Gelatin is often used as a binder for silver halide photographic light-sensitive materials.

Since gelatin is highly capable of swelling and gelling and easily crosslinkable with various hardeners, it serves excellently as a binder to uniformly coat a material which is sensitive to high temperature, such as light-sensitive silver halide, over a wide area of base by adjusting the physical properties of coating solution.

In silver halide photographic light-sensitive materials, silver halide grains change to very hard metallic silver during development while the gelatin layer is in a swollen condition with sufficient water absorption. This interferes with the recovery of the emulsion layer even after drying, which leads to dimensional difference before and after processing even within the same light-sensitive material.

Meanwhile, it is a well-known practice to improve physical properties of a light-sensitive material by adding polymer latex to the silver halide emulsion layer or backing layer. Examples of such methods are described in Research Disclosure No. 19951, Japanese Patent Examined Publication Nos. 4272/1964, 17702/1964 and 13482/1968, U.S. Pat. Nos. 2,376,005, 2,763,625, 2,772,166, 2,852,386, 2,853,457 and 3,397,988 and other publications. Also, Japanese Patent. Publication Open to Public Inspection (hereinafter referred to as Japanese Patent O. P. I. Publication) Nos. 38741/1984, 296348/1986, 284756/1986 and 285446/1986 and other publications disclose methods in which fine oil drops of paraffin or vinyl polymer are added. However, none of these methods are satisfactory, and further improvements have been needed. The problem to be solved is that conventional latices form a film (aggregation) and fail to have an effect even when the amount of addition is increased when they are added to gelatin in large amounts. This situation is undesirable for a dimensional stability improving effect; it is desired that a means will be developed of improving the wide variation of dimensional difference before and after processing depending on ambient temperature.

SUMMARY OF THE INVENTION

It is an object of the present invention to solve the problem of film formation by latex added in large amounts to gelatin layer and thus provide a silver halide photographic light-sensitive material which is excellent in dimensional stability, more specifically to develop a method of adding latex which offers an excellent dimensional stabilizing effect at low humidity.

The object described above can be accomplished by a silver halide photographic light-sensitive material comprising a support and at least one light-sensitive silver halide emulsion layer coated thereon wherein said at least one light-sensitive silver halide emulsion layer contains a polymer latex modified with gelatin.

It is a preferred mode of the present invention that the polymer contains not less than 70% by weight of gelatin, the Tg of the polymer latex is under 20° C., and the support is made of polyester and has a subbing layer containing a copolymer containing at least vinylidene chloride at not less than 20% on at least one face thereof.

The present invention is hereinafter described in detail.

DETAILED DESCRIPTION OF THE INVENTION

Ordinary latices are aqueously dispersed with surfactant, while the polymer latices which can be used for the present invention are characterized by dispersion and stabilization of the surface with gelatin. It is particularly desirable that the latex-constituting polymer and gelatin be coupled via a bond. In this case, the polymer and gelatin may bind directly or via a crosslinking agent. It is therefore desirable that the latex-constituting monomer have a reactive group such as a carboxyl group, amino group, amide group, epoxy group, hydroxyl group, aldehyde group, oxazoline group, ether group, ester group, methylol group, cyano group, acetyl group or unsaturated hydrocarbon bond. Substances which are commonly used as crosslinking agents for gelatin can be used for the present invention. Examples of such substances include crosslinking agents of the aldehyde, glycol, triazine, epoxy, vinyl sulfone, oxazoline, methacryl, acryl and other series.

A latex for the present invention can be obtained by adding a gelatin solution to the reaction system to cause another reaction after completion of polymer latex polymerization. Gelatin may be added to the polymer polymerization system in advance.

The present inventor made investigations of improvement in physical properties of light-sensitive materials and found that there is a critical point of the ratio of gelatin and latex added. Also found was that this effect is enhanced by choosing an appropriate value for the Tg of latex.

A marked dimensional stabilizing effect is obtained when the amount of latex added is not less than 70%, more preferably 70 to 200% of the amount of gelatin. When such a large amount of latex is added, the latex usually forms a film to interfere with further improvement in the dimensional stabilizing effect, but the latex of the present invention offers a marked dimensional stabilizing effect. The amount of gelatin in the emulsion layer is preferably not more than 3 $g/m^2$, more preferably not more than 2.5 $g/m^2$.

It was also found that the ambient temperature dependency of dimensional stability difference before and after processing can be markedly improved by lowering the Tg of latex below 20° C.

Examples of the polymer latex added to the photographic light-sensitive material of the present invention include the hydrates of vinyl polymers such as acrylates, methacrylates and styrene described in U.S. Pat. Nos. 2,772,166, 3,325,286, 3,411,911, 3,311,912 and 3,525,620, Research Disclosure No. 19551 (July, 1980) and other publications.

Examples of polymer latices which are preferably used for the present invention include homopolymers of methalkyl acrylates such as methyl methacrylate and ethyl methacrylate, homopolymers of styrene, copolymers of methalkyl acrylate or styrene and acrylic acid, N-methylolacrylamide, glycidol methacrylate or another component, homopolymers of alkyl acrylates such as methyl acrylate, ethyl acrylate and butyl acrylate, copolymers of alkyl acrylate and acrylic acid, N-methylolacrylamide or another component (preferably, the content of acrylic acid etc. is up to 30% by weight), homopolymers of butadiene, copolymers of butadiene and one or more of styrene, butoxymethylacrylamide and acrylic acid, and tertiary copolymers of vinylidene chloride, methyl acrylate and acrylic acid.

As long as the polymer latex is added to at least one silver halide light-sensitive emulsion layer for the present invention, it may b added to any other layer. It may also be added to one or both faces of the support. The latex added to another layer may be selected from the group comprising conventional latices. When the polymer latex is added to both faces of the support, the kind and/or amount of polymer latex added may be the same or not in the two faces.

The average grain size of the polymer latex for the present invention preferably ranges from 0.005 to 1 μm, more preferably 0.02 to 0.5 μm.

Some examples of latices which can be used for the present invention are given below. Although the Tg of these latices is preferably under 20° C., the examples of latex given in the present specification include latices wherein the components are contained in different compositions, since it is easily possible to adjust the Tg of a polymer latex comprising a copolymer of two or more components by changing the ratio of the components. It should be noted that the examples of latex given below represent only a very few usable latices, and these examples are not to be construed as limitative on not only the composition but also the components of latices for the present invention.

EXAMPLES OF LATEX

L-1

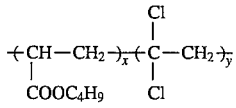

(x/y = 50/50)

L-2

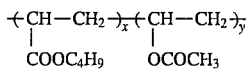

(x/y = 50/50)

L-3

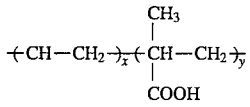

(x/y = 95.6/4.4)

L-4

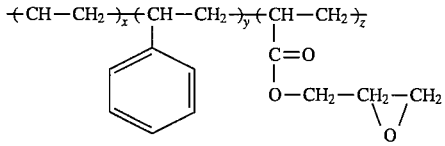

(x/y/z = 40/20/40)

L-5

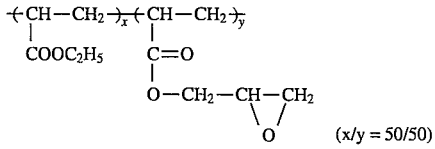

(x/y = 50/50)

L-6

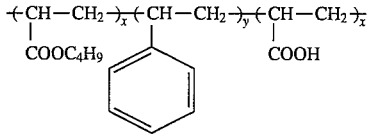

(x/y/z = 39.4/59/1.6)

L-7

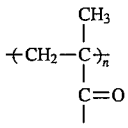

R: $-CH_3$, $C_2H_5$, $C_4H_9$

L-8

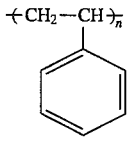

L-9

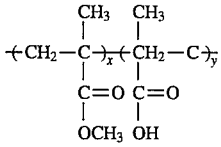

(x/y = 93/7)

-continued
L-10
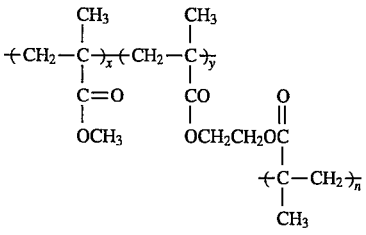
(x/y = 93/7)
L-11
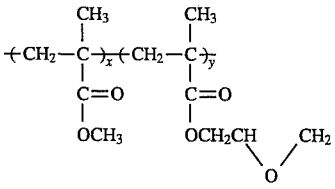
(x/y = 93/7)
L-12
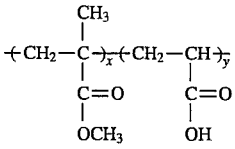
(x/y = 93/7)
L-13
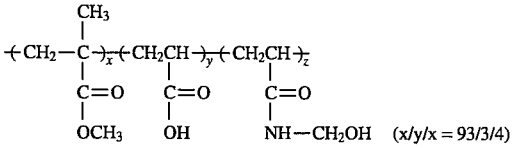
(x/y/x = 93/3/4)
L-14
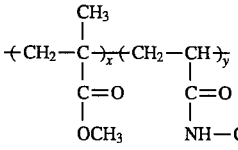
(x/y = 93/7)
L-15
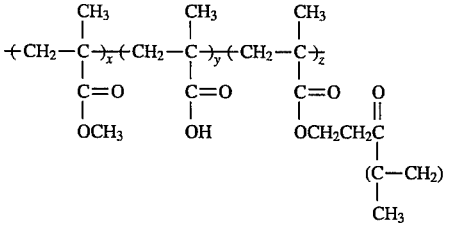
(x/y/z = 93/3/4)
L-16
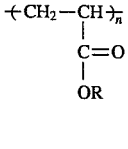
R: $-CH_3$, $C_2H_5$, $C_4H_9$
L-17
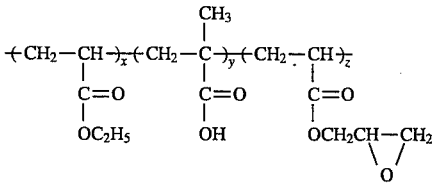
(x/y/z = 93/3/4)
L-18
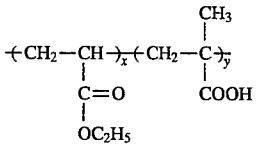
(x/y = 93/7)

-continued

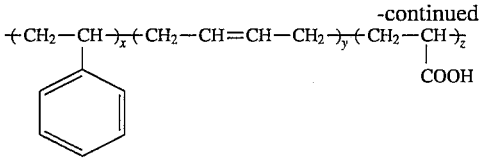

L-19

(x/y/z = 59/39/2)

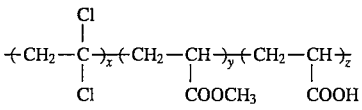

L-20

(x/y/z = 85/13/2)

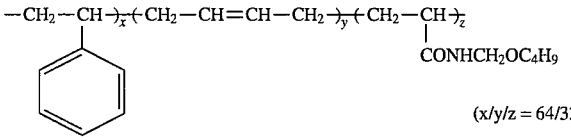

L-21

(x/y/z = 64/33/3)

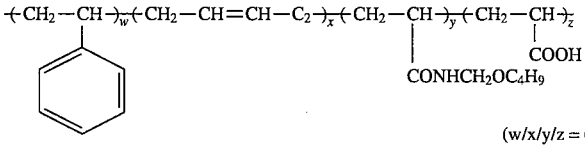

L-22

(w/x/y/z = 63/32/3/2)

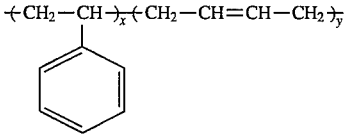

L-23

(x/y = 67/33)

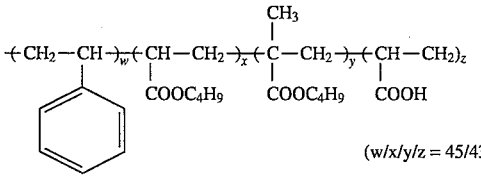

L-24

(w/x/y/z = 45/43/8/4)

The average grain size of the polymer latex for the present invention preferably ranges from 0.005 to 1 μm, more preferably 0.02 to 0.1 μm.

The amount of latex added to the silver halide emulsion layer is preferably not less than 70%, more preferably 70 to 200% of the amount of gelatin. The amount of gelatin in the emulsion layer is preferably not more than 3 g/m$^2$, more preferably not more than 2.5 g/m$^2$.

The polymer latex for the present invention may be added to one face of the support or both faces. When it is added to both faces of the support, the kind and/or amount of polymer latex added may be the same or not in the two faces.

When polymer latex is contained in at least one silver halide emulsion layer on the support, it may be added to any layer in addition to the light-sensitive hydrophilic colloidal layer.

With respect to the methods of preparation, sensitization, etc. of the ordinary additives, known contrast improvers and silver halide grains for the present invention, there is no limitation; Japanese Patent O. P. I. Publication No. 230035/1988 and Japanese Patent Application No. 266640/1989, for instance, serve as references.

In the present invention, to obtain an antistatic effect, another desirable property of light-sensitive materials, one or more antistatic layers may be formed on the backing and/or emulsion layer side of the support.

In this case, the surface resistivity of the antistatic layer side is preferably not more than $1.0\times10^{11}\Omega$, more preferably not more than $8\times10^{11}\Omega$ at a temperature of 25° C. and a humidity of 50%.

The antistatic layer preferably contains an electro-conductive substance such as a water-soluble electro-conductive polymer, a hydrophobic polymer grains, a reaction product of hardener or a metal oxide.

Examples of the water-soluble electro-conductive polymer include polymers having at least one electro-conductive group selected from the group comprising sulfonic acid group, sulfate group, quaternary ammonium salt group, tertiary ammonium salt group, carboxyl group and polyethylene oxide group. Of these groups, sulfonic acid group, sulfate group and quaternary ammonium salt group are preferred. The electro-conductive group content must be not less than 5% by weight per molecule of the water-soluble electro-conductive polymer.

The water-soluble electro-conductive polymer contains a carboxyl group, hydroxyl group, amino group, epoxy group, aziridine group, active methylene group, sulfinic acid group, aldehyde group, vinyl sulfone group or another group, of which the carboxyl group, hydroxyl group, amino group, epoxy group, aziridine group and aldehyde group are preferred. The content of these groups must be not less than 5% by weight per molecule of the polymer. The number-average molecular weight of the water-soluble electro-conductive polymer is normally 3000 to 100000, preferably 3500 to 50000.

Examples of substances which are preferably used as the metal oxide described above include tin oxide, indium oxide, antimony oxide, zinc oxide and those prepared by doping these metal oxides with metallic phosphorus or metallic indium. The average grain size of these metal oxides is preferably 0.01 to 1μ.

When the lower layer is an emulsion layer, the matting agent enters in the emulsion layer under pressure while the layer remains soft, and partial destruction of the emulsion layer occurs, which in turn can cause a coating failure. Winding tension poses a similar problem.

Any known matting agent can be used for the present invention. Examples of such matting agents include grains of inorganic substances such as the silica described in Swiss Patent No. 330,158, the glass powder described in French Patent No. 1,296,995, the alkaline earth metals or carbonates of cadmium, zinc, etc. described in British Patent No. 1,173,181, and organic grains such as the starch described in U.S. Pat. No. 2,322,037, the starch derivatives described in Belgian Patent No. 625,451 or British Patent No. 981,198, the polyvinyl alcohol described in Japanese Patent Examined Publication No. 3643/1969, the polystyrene and polymethyl methacrylate described in Swiss Patent No. 330,158, the polyacrylonitrile described in U.S. Pat. No. 3,079,257 and the polycarbonate described in U.S. Pat. No. 3,022,169.

These matting agents may be used singly or in combination. Although the matting agent is preferably spherical if it is not amorphous, other forms such as tabular and cubic forms may be used. The size of matting agent is expressed in the diameter of a sphere converted from the volume thereof. In the present invention, the matting grain size means the diameter of this sphere as so converted.

It is a preferred mode of the present invention that the outermost layer on the emulsion face side contain at least one matting agent with a definite and/or amorphous form having a matting grain size of not less than 4 μm at 4 to 80 $mg/m^2$. It is more preferable that at least one definite and/or amorphous matting agent having a grain size of less than 4 μm at 4 to 80 $mg/m^2$ be contained.

It is preferable that at least a part of the matting agent be contained in the outermost layer, and a part of the matting agent may reach a layer below the outermost layer.

For the matting agent to perform its basic function, it is desirable that a part of the matting agent be exposed to the surface. The matting agent exposed to the surface may be a part or all of the matting agent added. The matting agent may be added by coating after dispersion in a coating solution or by spraying before completion of drying after applying the coating solution. When a plurality of matting agents are added, these two methods may be used in combination. Methods of more efficiently adding these matting agents to light-sensitive materials are described in Japanese Patent Application No. 228762/1989 and other publications.

Examples of the subbing layer for the present invention include the subbing layers prepared using an organic solvent system containing polyhydroxybenzene, described in Japanese Patent O. P. I. Publication No. 3972/1974, and the aqueous latex subbing layers described in Japanese Patent O. P. I. Publication Nos. 11118/1974, 104913/1977, 19941/1984, 19940/1984, 18945/1984, 112326/1976, 117617/1976, 58469/1976, 114120/1976, 121323/1976, 123139/1976, 114121/1976, 139320/1977, 65422/1977, 109923/1977, 119919/1977, 65949/1980, 128332/1982 and 19941/1984 and other publications. It is more preferable to form an antistatic layer as described in Japanese Patent Application Nos. 140872/1989, 143914/1989, 323607/1989, 181306/1989, 18305/1989, 189663/1989 and 19748/1989.

The vinylidene chloride subbing layers described in U.S. Pat. Nos. 2,698,235, 2,779,684, 425,421 and 4,645,731 and other publications may also be mentioned.

The subbing layer may be subjected to chemical or physical surface treatment. Such treatments are performed for the purpose of surface activation, including chemical treatment, mechanical treatment, corona discharge, flaming, ultraviolet irradiation, high frequency wave treatment, glow discharge, active plasma treatment, laser treatment, mixed acid treatment and ozonization.

The subbing layer, unlike the coating layer for the present invention, is not subject to any limitation with respect to the timing or conditions of coating.

However, it is a preferred mode of embodiment of the present invention to coat it on a polyester support with a vinylidene chloride subbing layer, since the effect of the invention is enhanced.

Examples of the vinylidene chloride copolymer for the present invention include copolymers containing vinylidene chloride at 70 to 99.5% by weight, preferably 85 to 99% by weight, the copolymer comprising vinylidene chloride, acrylate and a vinyl monomer having an alcohol in the side chain described in Japanese Patent O. P. I. Publication No. 135526/1976, the vinylidene chloride/alkyl acrylate/acrylic acid copolymer described in U.S. Pat. No. 2,852,378, the vinylidene chloride/acrylonitrile/itaconic acid copolymer described in U.S. Pat. No. 2,698,235 and the vinylidene chloride/alkyl acrylate/itaconic acid copolymer described in U.S. Pat. No. 3,788,856. Specifically, the vinylidene chloride copolymer is exemplified by the following compounds:

Figures in parentheses are ratio by weight.

Vinylidene chloride/methyl acrylate/hydroxyethyl acrylate (83:12:2) copolymer

Vinylidene chloride/ethyl methacrylate/hydroxypropyl acrylate (82:10:8) copolymer Vinylidene chloride//hydroxydiethyl methacrylate (92:8) copolymer Vinylidene chloride/butyl acrylate/acrylic acid (94:4:2) copolymer Vinylidene chloride/butyl acrylate/itaconic acid (75:20:5) copolymer Vinylidene chloride/methyl acrylate/itaconic acid (90:8:2) copolymer Vinylidene chloride//methyl acrylate/methacrylic acid (93:4:3) copolymer Vinylidene chloride/monoethyl itaconate (96:4) copolymer Vinylidene chloride/acrylonitrile/acrylic acid (96:3.5:1.5) copolymer Vinylidene chloride/methyl acrylate/acrylic acid (90:5:5) copolymer Vinylidene chloride/ethyl acrylate/acrylic acid (92:5:2) copolymer Vinylidene chloride/methyl acrylate/3-chloro-2-hydroxypropyl acrylate (84:9:7) copolymer Vinylidene chloride/methyl acrylate/N-ethanolacrylamide (85:10:5) copolymer The plastic film having an antistatic layer of the present invention is applicable to a support for light-sensitive materials, for instance. Examples of the light-sensitive material include silver halide color light-sensitive materials, light-sensitive materials for roentgenography and light-sensitive materials for photochemical process.

In the present invention, in addition to ordinary water-soluble dyes, a solid-dispersed dye may be added to a hydrophilic colloidal layer, which layer may be the outermost layer on the emulsion face side. The dye may be added to a layer below the emulsion layer and/or the backing face side for prevention of halation and other purposes. An appropriate amount of the dye may be added also to the emulsion layer to obtain controlled irradiation. It is of course possible that a number of solid-dispersed dyes may be contained in two or more layers.

The amount of solid-dispersed dye added is preferably 5 $mg/m^2$ to 1 $g/m^2$, more preferably 10 to 800 $mg/m^2$ for each kind.

The fine grains of solid dispersion used can be prepared by milling the dye using a dispersing machine such as a ball mill or sand mill and dispersing it along with water or a hydrophilic colloid such as gelatin and a surfactant such as sodium dodecylbenzenesulfonate, fluorinated sodium octylbenzenesulfonate, saponin or nonylphenoxypolyethylene glycol.

Examples of the dyes for the present invention include those described in U.S. Pat. No. 4,857,446 and other publications, with preference given to those represented by Formulas I through V.

Although the present invention is applicable to various light-sensitive materials such as those for printing, X-ray photography, ordinary negative films, ordinary reversal films, ordinary positive films and direct positive films, a marked effect is obtained when it is applied to light-sensitive materials for printing, which are required to have very high dimensional stability.

The developing temperature for the silver halide photographic light-sensitive material of the present invention is preferably under 50° C., more preferably about 25° to 40° C. The developing lime is normally within 2 minutes, but better results are obtained in rapid processing for 5 to 60 seconds.

EXAMPLES

The present invention is hereinafter described in more detail by means of the following examples, but the invention is not by any means limited by these examples.

Example 1

Synthesis of Latex Lx-1

To 40 l of water were added 0.125 kg of gelatin and 0.05 kg of ammonium persulfate. To this solution while being stirred at 80° C., a mixture of 4.51 kg of (i) n-butyl acrylate, 5.49 kg of (ii) styrene and 0.1 kg of (iii) acrylic acid was added in nitrogen atmosphere over a period of 1 hour. After stirring for 1.5 hours, 1.25 kg of gelatin and 0.005 kg of ammonium persulfate were added, followed by additional stirring for 1.5 hours. After completion of the reaction, the remaining monomer was distilled off by steam distillation for 1 hour, after which the distillate was cooled to room temperature and adjusted to a pH of 6.0 with ammonia. The resulting latex solution was diluted with water to make a total quantity of 50.5 kg.

A monodispersed latex having an average grain size of 0.25 μm and a Tg of about 0° C. was thus obtained.

Synthesis of Comparative Latex Lx-2

A latex Lx-2 was synthesized in the same manner as with Lx-1 except that 0.25 kg of KMDS (sodium salt of dextran sulfate, produced by Meito Sangyo Co., Ltd.), in place of gelatin, was added to the system before polymerization and gelatin was not added after adding the monomer.

Preparation of Emulsion

A solution of silver sulfate and a solution prepared by adding rhodium hexachloride complex to an aqueous solution of sodium chloride and potassium bromide to $8\times10^{-5}$ mol/Agmol silver were simultaneously added to a gelatin solution while controlling the flow rate. The resulting mixture was desalted to yield a monodispersed silver chlorobromide emulsion comprising cubic crystal grains having a grain size of 0.13μ and a silver bromide content of 1 mol %.

This emulsion was sensitized with sulfur by an ordinary method. After adding a stabilizer 6-methyl-4-hydroxy- 1,3, 3a,7-tetrazaindene, the following additives were added to yield emulsion coating solutions E-1 through 14. Then, an emulsion protective layer coating solution P-0, a backing layer coating solution B-0 and a backing protective layer coating solution BP-0 were prepared from the following compositions.

Preparation of emulsion coating solutions E-1 through 14

| | |
|---|---|
| Compound a | 1 $mg/m^2$ |
| NaOH (0.5 N) Added to obtain a pH of 5.6. | |
| Compound b | 40 $mg/m^2$ |
| Compound c | 30 $mg/m^2$ |
| Saponin (20%) | 0.5 $cc/m^2$ |
| Sodium dodecylbenzenesulfonate | 20 $mg/m^2$ |
| 5-methylbenzotriazole | 10 $mg/m^2$ |
| Compound d | 2 $mg/m^2$ |
| Compound e | 10 mg |
| Compound f | 6 $mg/m^2$ |
| Latex La See Table 1. | |
| Styrene-maleic acid aqueous copolymer (thickener) | 90 $mg/m^2$ |

(a)

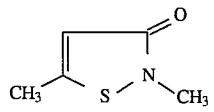

-continued (b)

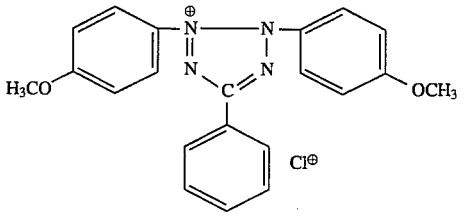

(c)

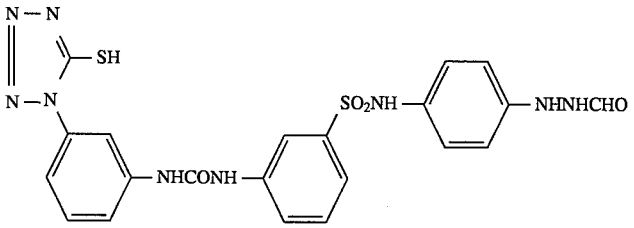

(d)

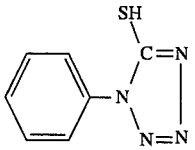

(e)

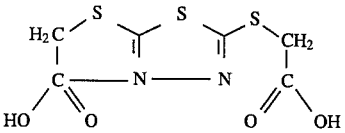

(f)

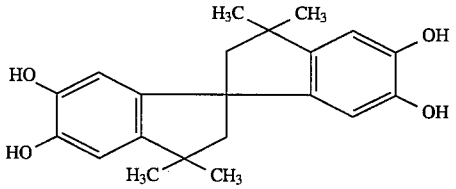

| Emulsion protection layer coating solution P-0 | |
|---|---|
| Gelatin | 0.5 g/m$^2$ |
| Compound g (1%) | 25 cc/m$^2$ |
| Compound h | 120 mg/m$^2$ |
| Spherical monodispersed silica (8μ) | 20 mg/m$^2$ |
| Spherical monodispersed silica (3μ) | 10 mg/m$^2$ |
| Compound i | 100 mg/m$^2$ |
| Citric acid Added to obtain a pH of 6.0. | |

| Backing layer coating solution B-0 | |
|---|---|
| Gelatin | 1.0 g/m$^2$ |
| Compound j | 100 mg/m$^2$ |
| Compound k | 18 mg |
| Compound l | 100 mg/m$^2$ |
| Saponin (20%) | 0.6 cc/m$^2$ |
| Latex m | 300 mg/m$^2$ |
| 5-nitroindazole | 20 mg/m$^2$ |
| Styrene-maleic acid aqueous copolymer (thickener) | 45 mg/m$^2$ |
| Glyoxal | 4 mg/m$^2$ |

| Backing protective layer coating solution BP-0 | |
|---|---|
| Gelatin | 0.5 g/m$^2$ |
| Compound g (1%) | 2 cc/m$^2$ |
| Spherical polymethyl methacrylate (4μ) | 25 mg/m$^2$ |
| Sodium chloride | 70 mg/m$^2$ |
| Glyoxal | 22 mg/m$^2$ |

-continued
| Compound n | 10 mg/m$^2$ |
|---|---|
(g)
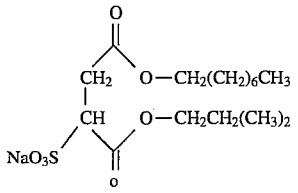
(h)
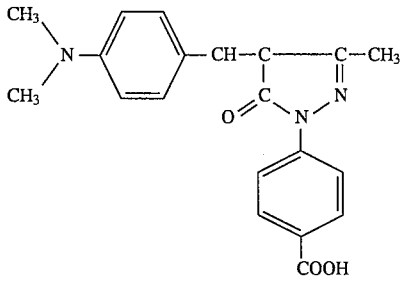
(solid-dispersed dye)
(i)
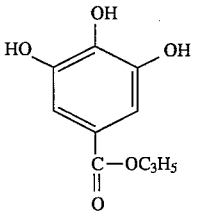
(j)
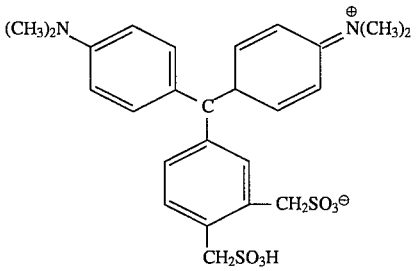
(k)
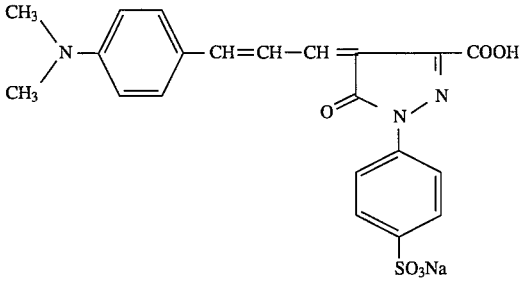

-continued (l)

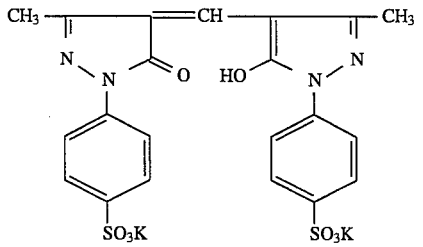

(m)

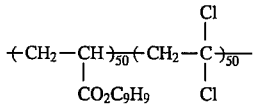

(n)

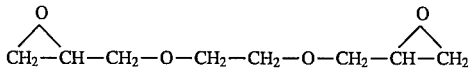

The coating solutions thus prepared, in the following compositions, were each coated on a polyethylene terephthalate base of 100μ in thickness subbed as described in Japanese Patent O. P. I. Publication No. 19941/1984 using a roll fit coating pan and an air knife after corona discharge at 10 W/(m$^2$.min). Drying was carried out in a parallel stream of hot blow at 90° C. for 30 seconds and subsequently at 140° C. for 90 seconds with an overall coefficient of heat transfer of 25 kcal (m$^2$.hr.°C.). After drying, the layer had a thickness of 1μ and a surface resistivity of $1\times10^8\Omega$ at a temperature of 23° C. and a humidity of 55%.

Water-soluble polymer 70 g/l

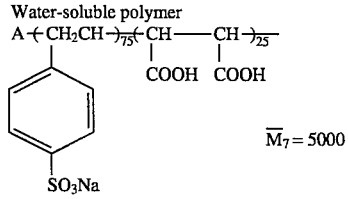

$\overline{M}_7 = 5000$

Hydrophobic polymer grains 40 g/l

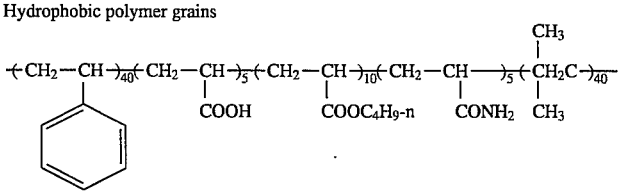

Ammonium sulfate 0.5 g/l

Polyethylene oxide compound (average molecular weight 600) 6 g/l

Hardener 12 g/l

Mixture of

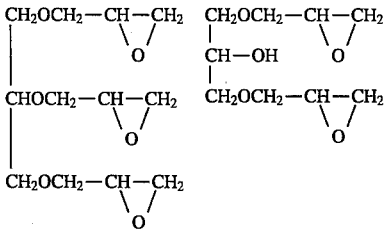

-continued

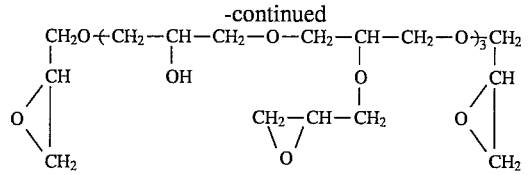

On this base, an emulsion layer and an emulsion protective layer were double coated by the slide hopper method in this order from the support side for the emulsion face side while keeping a temperature of 35° C. and while adding a hardener solution. After passing the base through a cold blow set zone at 5° C., a backing layer and a backing protective layer were similarly coated using a slide hopper while adding a hardener and set with cold blow at 5° C. Each coating solution showed satisfactory setting upon passing each set zone. Subsequently, both faces were dried in a drying zone under the following drying conditions. After coating both faces of backing, the light-sensitive material was transported with no contact with the rollers or other devices until winding. The coating rate of 100 m/min.

Drying Conditions

After setting, the light-sensitive material was dried with dry blow at 30° C. until the weight ratio of $H_2O$ and gelatin reached 800%, followed by drying with dry blow at 35° C. (30%) until the weight ratio decreased from 800% to 200%. Hot blow was further supplied, and 30 seconds after the surface temperature reached 34° C. (regarded as completion of drying), the light-sensitive material was dried with air at a temperature of 48° C. and a humidity of 16% for 1 minute. The drying times were 50 seconds from initiation of drying to obtainment of an $H_2O$/gel ratio of 800%, 35 seconds from 800% to 200% and 5 seconds from 200% to completion of drying.

This light-sensitive material was wound up at a temperature of 23° C. and a humidity of 40%, cut under the same conditions and then tightly packed in a barrier bag subjected to humidity conditioning under the same conditions for 3 hours along with thick paper subjected to humidity conditioning at a temperature of 40° C. and a humidity of 10% for 8 hours and then at a temperature of 23° C. and a humidity of 40% for 2 hours.

In the light-sensitive material thus prepared, the amount of silver coated was 3.5 g/m$^2$.

Evaluation sample Nos. 1 through 14 thus prepared were evaluated as to dimensional stability as follows.

Dimensional stability

The sample was cut into a piece of 30 cm×60 cm and subjected to image exposure for two thin lines at a distance of about 56 cm using a daylight printer P-627FM (produced by Dainippon Screen Mfg. Co., Ltd.) and developed to yield an original.

After humidity conditioning of the original, an unexposed sample (the same size as with the original), the printer and the automatic developing machine at a temperature of 23° C. and a humidity of 20% for 2 hours, the unexposed sample was subjected to face-to-face contact exposure to the original and developed using the automatic developing machine. After humidity conditioning for 2 hours, the developed sample was superposed on the original, and the change in the distance of the two solid lines was measured using a scaled magnifying glass.

The number of measuring points were n=6, and the average was taken for the six measurements (value-a). A similar experiment was made at a temperature of 23° C. and a humidity of 60%, the change in the dimensional difference before and after processing at a humidity of 20% (indicating the dependency on ambient temperature) was obtained (value-b).

When the value-a exceeds ±20μ, a dimensional change is recognized; when the value-b exceeds 20μ, a change in dimensional difference before and after processing is recognized. These are thus critical levels where any change is needed in the operational condition settings.

Standard processing conditions

Development 28° C. 30 seconds

Fixation 28° C. 20 seconds

Washing Normal temperature 15 seconds

Drying 40° C. 35 seconds

| Compositions of developer | |
|---|---|
| Composition A | |
| Pure water (ion exchange water) | 150 ml |
| Disodium ethylenediaminetetraacetate | 2 g |
| Diethylene glycol | 50 g |
| Potassium sulfite (55% w/v aqueous solution) | 100 ml |
| Potassium carbonate | 50 g |
| Hydroquinone | 15 g |
| 5-methylbenzotriazole | 200 mg |
| 1-phenyl-5-mercaptotetrazole | 30 mg |
| Potassium hydroxide Added to obtain a pH of 10.9 for the solution. | |
| Potassium bromide | 4.5 g |
| Composition B | |
| Pure water (ion exchange water) | 3 ml |
| Diethylene glycol | 50 mg |
| Disodium ethylenediaminetetraacetate | 25 mg |
| Sulfuric acid (90% aqueous solution) | 0.3 ml |
| 5-nitroindazole | 110 mg |
| 1-phenyl-3-pyrazolidone | 500 mg |

Upon use of the developer, the above compositions A and B were dissolved in 500 ml of water in this order, and the solution was filled to make a total quantity of 1 l.

| Compositions of fixer | |
|---|---|
| Composition A | |
| Ammonium thiosulfate (72.5% w/v aqueous solution) | 230 ml |
| Sodium sulfite | 9.5 g |
| Sodium sulfate trihydrate | 15.9 g |
| Boric acid | 6.7 g |
| Sodium citrate dehydrate | 2 g |
| Sulfuric acid (90% w/v aqueous solution) | 8.1 ml |
| Composition B | |
| Pure water (ion exchange water) | 17 ml |
| Sulfuric acid (50% w/v aqueous solution) | 5.8 g |
| Aluminum sulfate (aqueous solution containing 8.1% w/v $Al_2O_3$) | 26.5 g |

Upon use of the fixer, the above compositions A and B were dissolved in 500 ml of water in this order, and the solution was filled to make a total quantity of 1 l. This fixer had a pH of about 4.3.

The results are shown in Table 1.

TABLE 1

| Sample number | Kind of latex | Gel/Lx * (g/m²) | Dimensional difference before and after processing (a) | (b) | |
|---|---|---|---|---|---|
| 1 | — | 2.0/0 | +60 μm | +70 μm | Comparative |
| 2 | Lx-1 | 2.0/1.0 | +35 | +37 | Inventive |
| 3 | Lx-1 | 2.0/1.4 | +25 | +20 | Inventive |
| 4 | Lx-1 | 2.0/2.0 | +18 | +15 | Inventive |
| 5 | Lx-1 | 2.0/4.0 | +15 | +10 | Inventive |
| 6 | Lx-2 | 2.0/1.0 | +32 | +52 | Comparative |
| 7 | Lx-2 | 2.0/1.4 | +27 | +48 | Comparative |
| 8 | Lx-2 | 2.0/2.0 | +23 | +44 | Comparative |
| 9 | Lx-2 | 2.0/4.0 | +22 | +42 | Comparative |

Note: Expressed as solid content.

The inventive Lx-1 proved to have a markedly lower value-b in comparison with the comparative latex Lx-2.

Example 2

Evaluation sample Nos. 10 through 23 were prepared using the inventive latex Lx-1 synthesized in Example 1 with the ratio of gelatin and latex added to the emulsion layer varied as shown in Table 2, and tested in the same manner as in Example 1.

The results are shown in Table 2.

TABLE 2

| Sample number | Gel/Lx * (g/m²) | Dimensional difference before and after processing (a) | (b) | |
|---|---|---|---|---|
| 10 | 2.0/0 | +60 μm | +70 μm | Comparative |
| 11 | 2.0/1.0 | +35 | +50 | Inventive |
| 12 | 2.0/1.4 | +25 | +20 | Inventive |
| 13 | 2.0/2.0 | +20 | +15 | Inventive |
| 14 | 2.0/3.0 | +20 | +10 | Inventive |
| 15 | 1.0/0 | +45 | +55 | Comparative |
| 16 | 1.0/0.5 | +32 | +52 | Inventive |
| 17 | 1.0/0.7 | +22 | +18 | Inventive |
| 18 | 1.0/1.0 | +15 | +14 | Inventive |
| 19 | 1.0/2.0 | +17 | +12 | Inventive |
| 20 | 0.5/0.25 | +27 | +37 | Inventive |
| 21 | 0.5/0.35 | +12 | +18 | Inventive |
| 22 | 0.5/0.5 | +9 | +15 | Inventive |
| 23 | 0.5/1.0 | +8 | +10 | Inventive |

Example 3

Latices La-1 through 4 were synthesized in the same manner as in Example 2 except that the Tg was changed by varying the copolymerization ratio of n-butyl acrylate and styrene in the inventive latex composition synthesized in Example 2. Latices Lb-1 through 4 were synthesized in the same manner as in Example 1 except that ethyl acrylate was used in place of n-butyl acrylate and methyl methacrylate was used in place of styrene and the Tg was changed by varying the compositional ratio thereof. From these latices, samples were prepared using the composition of sample No. 18 of Example 2, and their dimensional stability was determined in comparison with sample No. 15 of Example 2. The results are shown in Table 3.

TABLE 3

(all samples were obtained in accordance with the present invention)

| No. | Lx | Compositional ratio (mol)* | Tg (°C.) | Dimensional difference before and after processing (a) | (b) |
|---|---|---|---|---|---|
| 24 | La-1 | 7/91/2 | 80 | +37 μm | +30 μm |
| 25 | La-2 | 28/70/2 | 30 | +35 | +23 |
| 26 | La-3 | 34/64/2 | 18 | +15 | +20 |
| 27 | La-4 | 60/38/2 | −25 | +13 | +15 |
| 28 | Lb-1 | 13/85/2 | 65 | +38 | +32 |
| 29 | Lb-2 | 35/68/2 | 25 | +35 | +28 |
| 30 | Lb-3 | 38/60/2 | 20 | +17 | +19 |
| 31 | Lb-4 | 64/34/2 | −15 | +11 | +18 |

*i/ii/iii

The dimensional difference before and after processing at a temperature of 23° C. and a humidity of 20%, which conditions make the Tg below 20° C., was found to decrease by about 20μ in comparison with the case where the Tg exceeds 20° C.

Example 4

Evaluation sample Nos. 32 through 40 were prepared in the same manner as in Example 1 except that the PET base was subbed with vinylidene chloride as described in U.S. Pat. No. 4,645,731 for the mode of the present invention described in Example 2. These samples were evaluated in the same manner as in Example 2. The results are shown in Table 4.

TABLE 4

| Sample number | Gel/Lx * (g/m²) | Dimensional difference before and after processing (a) | (b) | |
|---|---|---|---|---|
| 32 | 2.0/1.4 | +25 μm | +15 μm | Inventive |
| 33 | 2.0/2.0 | +18 | +13 | Inventive |
| 34 | 2.0/3.0 | +16 | +8 | Inventive |
| 35 | 1.0/0.7 | +14 | +11 | Inventive |
| 36 | 1.0/1.0 | +13 | +9 | Inventive |
| 37 | 1.0/2.0 | +10 | +8 | Inventive |
| 38 | 0.5/0.35 | +10 | +12 | Inventive |
| 39 | 0.5/0.5 | +6 | +7 | Inventive |
| 40 | 0.5/1.0 | +8 | +7 | Inventive |

It is evident that the dimensional stabilizing effect was enhanced by vinylidene chloride subbing.

Example 5

Sample Nos. 41 through 49 were prepared in the same manner as in Example 4 except for the following processing conditions, and tested in the same manner. The results are shown in Table 5.

| Rapid processing conditions | | |
|---|---|---|
| Development | 28° C. | 8 seconds |
| Fixation | 28° C. | 8 seconds |
| Washing | Normal temperature | 6 seconds |
| Drying | 40° C. | 6 seconds |

TABLE 5

| Sample number | Gel/Lx * (g/m²) | Dimensional difference before and after processing (a) | (b) | |
|---|---|---|---|---|
| 41 | 2.0/1.4 | +15 μm | +9 μm | Inventive |
| 42 | 2.0/2.0 | +8 | +8 | Inventive |
| 43 | 2.0/3.0 | +6 | +8 | Inventive |
| 44 | 1.0/0.7 | +14 | +11 | Inventive |
| 45 | 1.0/1.0 | +6 | +9 | Inventive |
| 46 | 1.0/2.0 | +5 | +7 | Inventive |
| 47 | 0.5/0.35 | +4 | +7 | Inventive |
| 48 | 0.5/0.5 | +3 | +7 | Inventive |
| 49 | 0.5/1.0 | +2 | +7 | Inventive |

It is evident that rapid processing enhanced the dimensional stabilizing effect.

As is evident from Examples 1 through 5, the present invention makes it possible to provide a light-sensitive material which is excellent in dimensional stability.

What is claimed is:

1. A method for processing a silver halide photographic material comprising;

performing a face-to-face contact exposure of said photographic material to an original by means of a light source, and developing said photographic material, wherein said silver halide photographic material comprises a support and a silver halide emulsion layer comprising gelatin and a gelatin modified latex in an amount of 70% to 200% by weight of gelatin present in said emulsion layer, said gelatin modified latex being produced by polymerization of a latex in the presence of gelatin.

2. The method of claim 1, wherein said gelatin modified latex is present in an amount not less than 100% by weight of said gelatin present in said emulsion layer.

3. The method of claim 1, wherein said photographic material further comprises a layer containing a copolymer containing a vinylidene chloride unit.

4. The method of claim 3, wherein said layer containing said copolymer is a subbing layer.

5. The method of claim 4, wherein said copolymer contains a vinylidene chloride in an amount 70 to 99.5% by weight of said copolymer.

6. The method of claim 5, wherein said copolymer contains a vinylidene chloride in an amount 85 to 99% by weight of said copolymer.

7. The method of claim 1, wherein said latex, prior to polymerization, has a Tg of not more than 20° C.

8. The method of claim 1, wherein the amount of gelatin in said layer is not more than 3 g/m².

9. The method of claim 1, wherein said silver halide photographic material further comprises an antistatic layer on the emulsion layer side or on the other side of the support.

10. The method of claim 9, wherein the surface resistivity of the antistatic layer side is not more than $1.0\times10^{11}\Omega$ at a temperature of 25° C. and a humidity of 50%.

11. The method of claim 1, wherein said silver halide photographic material is developed at a temperature of less than 50° C.

12. The method of claim 1, wherein said silver halide photographic material is developed in 5 to 60 seconds.

13. A method for processing a silver halide photographic material comprising:

performing a face-to-face contact exposure of said photographic material to an original by means of a light source, and developing said photographic material, wherein said silver halide photographic material comprises a support, a subbing layer containing a copolymer containing vinylidene chloride in an amount not less than 20% by weight of said copolymer and a silver halide emulsion layer comprising a gelatin, a gelatin modified latex wherein the total amount of gelatin present in said emulsion layer is not more than 3 g/m², wherein said gelatin modified latex being produced by polymerization of a latex in the presence of gelatin.

14. The method of claim 13, wherein said silver halide photographic material is developed at a temperature between 25° and 40° C.

* * * * *